US006315694B1

(12) United States Patent
Osu et al.

(10) Patent No.: US 6,315,694 B1
(45) Date of Patent: Nov. 13, 2001

(54) FEEDFORWARD EXERCISE TRAINING MACHINE AND FEEDFORWARD EXERCISE EVALUATING SYSTEM

(75) Inventors: Rieko Osu, Kyoto; Kazuhisa Domen, Saitama, both of (JP)

(73) Assignee: Japan Science and Technology Corporation, Saitama (JP)

( * ) Notice: Subject to any disclaimer, the term of this patent is extended or adjusted under 35 U.S.C. 154(b) by 0 days.

(21) Appl. No.: 09/463,493

(22) PCT Filed: May 26, 1999

(86) PCT No.: PCT/JP99/02767

§ 371 Date: Apr. 4, 2000

§ 102(e) Date: Apr. 4, 2000

(87) PCT Pub. No.: WO99/61110

PCT Pub. Date: Dec. 2, 1999

(30) Foreign Application Priority Data

May 27, 1998 (JP) ..... 10-146335

(51) Int. Cl.[7] ..... A61B 5/00

(52) U.S. Cl. ..... 482/8; 482/9; 482/900

(58) Field of Search ..... 482/1–9, 900–902; 434/258; 601/23; 473/209

(56) References Cited

U.S. PATENT DOCUMENTS

| | | | | |
|---|---|---|---|---|
| 4,934,694 | * | 6/1990 | Mcintosh | 482/9 |
| 5,337,757 | * | 8/1994 | Jain et al. | 434/258 |
| 5,553,857 | * | 9/1996 | Fish | 473/209 |
| 5,810,747 | * | 9/1998 | Brudny et al. | 434/258 |
| 6,066,075 | * | 5/2000 | Poulton | 482/9 |

* cited by examiner

*Primary Examiner*—Glenn E. Richman
(74) *Attorney, Agent, or Firm*—Wenderoth, Lind & Ponack, L.L.P.

(57) ABSTRACT

A feedforward-movement training apparatus, which is capable of restoring functions of fast and accurate movements in a relaxed state by training feedforward-movements includes a movement working portion where a patient causes a body part to do, within a time limit, a feedforward-movement between a start point and an end point arranged in advance, a movement measuring portion for measuring the feedforward-movement of the patient, and a movement feedback portion for giving the result of the measurement made by the movement measuring portion to the patient. A feedforward-movement evaluation system objectively and easily evaluates the degree of skillfulness of the patient's feedforward-movements in the aforementioned feedforward-movement training apparatus and thus restores functions to execute fast and accurate movement in a relaxed state more effectively.

16 Claims, 7 Drawing Sheets

FEEDFORWARD EXERCISE TRAINING MACHINE AND FEEDFORWARD EXERCISE EVALUATING SYSTEM

TECHNICAL FIELD

The invention of this application relates to a feedforward-movement training apparatus and feedforward-movement evaluating system. More particularly, the invention of this application relates to a novel feedforward-movement training apparatus and feedforward-movement evaluating system which can effectively realize rehabilitation of functions permitting fast and accurate movements in a relaxed state and which is useful for evaluation of effectiveness of rehabilitation, therapies and medicines intended for improvement of motor functions.

BACKGROUND ART

In the past, rehabilitation of movement impairments due to stroke or the like has centered on training in a "slow and accuracy-requiring" movement, such as an insertion of peg, which is done while making corrections using visual and somatosensory feedback information or in a "quick but accuracy-non-requiring" movement.

However, the former training in a "slow and accuracy-requiring" movement tends to stiffen one's arm and leg. The latter training tends not to require accuracy. Consequently, it has been difficult to restore a motor function of a quick and accurate movement of one's arm, leg and the like, which are kept in a compliant and relaxed state, without corrections during their movements.

Such a quick and accurate movement, e.g., a movement of quickly reaching out one's hand to an object or a movement of throwing a ball toward a target, is known as a feedforward-movement. On the other hand, a movement of arranging objects or tracking an object while making corrections using visual or somatosensory information is known as a feedback-movement. The aforementioned "slow and accuracy-requiring" movement is an example of the feedback-movement.

For the feedback-movement, since a feedback controller is used, it is not necessary to create, within one's brain, a dynamics model of a body part such as an arm and a leg. On the other hand, to do the feedforward-movement, it is necessary to calculate a control signal in advance, using a dynamics model of a body part.

If the relation between the control signal and the body part's movement changes due to a movement impairment, the control signal can no longer be calculated correctly using the heretofore used dynamics model of the body part. Therefore, a new dynamics model must be re-created. This is effectively achieved by training the person in the feedforward-movement making positive use of a dynamics model.

Furthermore, restoration of a motor function has been assessed based on a psychological measurement obtained by doctor's observation, i.e., on an ordinal scale, thus an objective and quantitative evaluation based on a physical measurement, i.e., a ratio scale, has not been made.

In view of the foregoing circumstances, the invention of this application has been made, and it is an object of the invention to provide a novel feedforward-movement training apparatus which solves the problems with the prior arts and can realize restoration of functions to do fast and accurate movements in a relaxed state by training the feedforward-movements. It is another object of the invention to provide a novel feedforward-movement evaluating system which objectively and easily evaluates the degree of skillfulness of the patient's feedforward-movements in the feedforward-movement training apparatus and thus can more effectively restore fast and accurate motor functions in a relaxed state.

DISCLOSURE OF INVENTION

To solve the foregoing problems, the invention of this application provides a feedforward-movement training apparatus comprising a movement working portion where a patient causes a body part to do, within a time limit, a feedforward-movement between a start point and an end point arranged in advance, a movement measuring portion for measuring the feedforward-movement of the patient, and a movement feedback portion for giving the result of the measurement made by the movement measuring portion to the patient.

In this apparatus, at least one via-point is given between the start point and the end point, and the patient causes the body part to do a feedforward-movement from the start point to the end point through the via-point. The start point and the end point are placed on the movement working portion. The via-point is placed on the movement working portion. The movement measuring portion measures a trajectory of the feedforward-movement. The movement measuring portion measures a position of the body part during the feedforward-movement. The movement measuring portion measures a time taken to complete the feedforward-movement. The movement feedback portion displays the result of the measurement of the feedforward-movement to the patient. The start point and the end point are displayed on the movement feedback portion. The via-point is displayed on the movement feedback portion. The movement feedback portion displays the position of the body part in real-time during the feedforward-movement.

The invention of this application also provides a feedforward-movement evaluating system comprising the aforementioned feedforward-movement training apparatus and a feedforward-movement evaluating apparatus for evaluating the degree of skillfulness of the feedforward-movement done by the patient in the feedforward-movement training apparatus.

In this system, the feedforward-movement evaluating apparatus has a smoothness evaluating portion for evaluating, the smoothness of the feedforward-movement using the result of the measurement of the feedforward-movement made by the movement measuring portion of the feedforward-movement training apparatus. The feedforward-movement evaluating apparatus calculates, using the measurement of the feedforward-movement, at least one of a minimum hand jerk, a minimum joint-angle jerk, and a minimum torque change as a smoothness objective function value. The feedforward-movement evaluating apparatus has a compliance evaluating portion for evaluating compliance of the feedforward-movement using muscle tension of the body part doing the feedforward-movement on the movement working portion of the feedforward-movement training apparatus. The feedforward-movement evaluating apparatus calculates an integrated value of an electromyogram indicating a relative change of the muscle tension.

The symbols used in the figures indicate as follows:

1: patient;

2: hand;

3: movement working portion

31: working table;

32: start point;

33: end point;

34: via-point;

4: movement measuring portion;

5: movement feedback portion;

51: display;

6: smoothness evaluating portion;

7: compliance evaluating portion

BEST MODE FOR CARRYING OUT THE INVENTION

Figure 1:
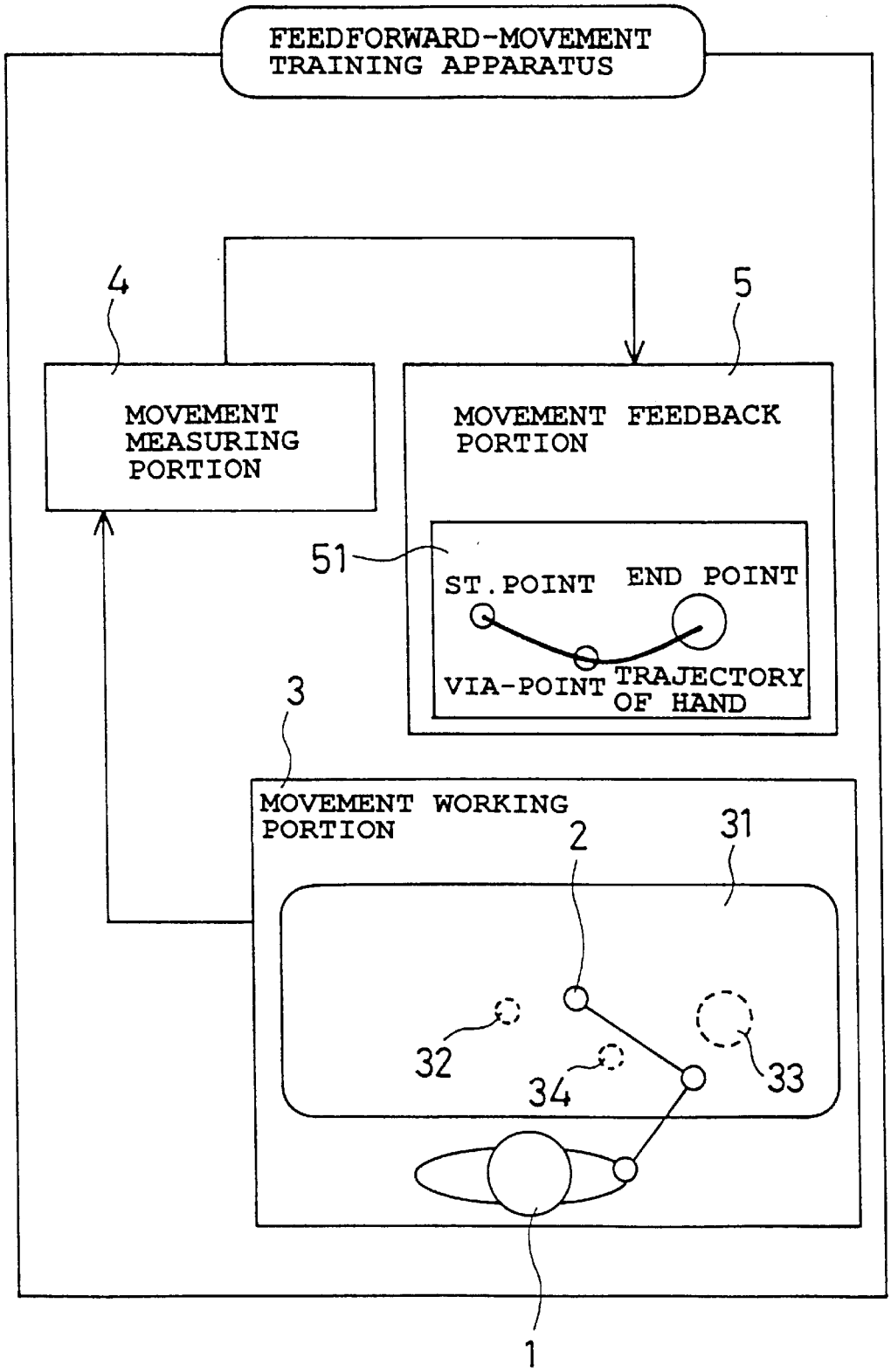
FIG. 1 is a schematic showing main portions of one example of feedforward-movement training apparatus of this invention.

FIG. 1 shows one example of feedforward-movement training apparatus of this invention.

As exemplified in FIG. 1, the feedforward-movement training apparatus of this invention comprises a movement working portion 3 where a patient 1 causes his or her body part to do a feedforward-movement, a movement measuring portion 4 for measuring the feedforward-movement, and a movement feedback portion 5 for giving to the patient the result of the measurement of the feedforward-movement made by the movement measuring portion 4.

In the example of FIG. 1, the body part which the patient 1 causes to do the feedforward-movement is a hand 2. The working portion 3 is, for example, equipped with a working table 31, which has a start point 32 and an end point 33 previously located on given positions within a flat plane so as to permit the patient 1 to do, using two joints of his or her shoulder and elbow, the feedforward-movement between the start point 32 and the end point 33 within a horizontal plane at a height of the shoulder. The flat surface of this working table 31 exhibits little friction.

Also, a device (not shown) for locking the wrist and a grip rod (not shown) capable of being gripped and slid on the flat surface of the working table 31 by the patient are provided A via-point 34 may be given between the start point 32 and the end point 33, depending on the degree of impairment of the patient 1, thereby setting an objective such as passing through the via-point 34. The number of the via-points 34 can be adjusted according to the degree of impairment.

On this movement working portion 3, the patient 1 moves the grip rod so that it starts from the start point 32, passes through the via-point 34, and reaches the end point 33 within a time limit. The time limit may be set relatively short in order to suppress corrective motion due to visual or somatosensory feedback, thereby urging to do a fast and precise movement without correction, i.e., a feedforward-movement.

The movement measuring portion 4 measures, for example, a trajectory of the feedforward-movement of the hand 2 of the patient 1, a position of the hand 2, positions and angles of joints, and a time taken to do the feedforward-movement (i. e., the time taken to go from the start point 31 to the end point 33).

The movement feedback portion 5 may be equipped with a display 51, for example. The results of the measurements of the feedforward-movement made by the movement measuring portion 4 are displayed on the display 51 and given to the patient 1 (feedback). For instance, the present position of the hand 2 during the feedforward-movement can be displayed in real-time or the trajectory can be displayed after completing the movement. Furthermore, information may also be displayed indicating whether the hand 2 successfully reached the end point 33 within the time limit or whether the hand 2 passed through the required via-point 34. In this way, the information can be given to the patient 1. Of course, instead of giving the results of the measurements to the patient via the display 51, the results may be printed on paper and given to the patient.

Because of the feedback of the results of the measurements as described above, the patient 1 can confirm his or her movement at any time. Consequently, the patient can be trained to execute more accurate feedforward-movement.

Instead of placing the start point 32, the end point 33, and the via-point 34 for the feedforward-movement on the movement working portion 3, they may be displayed on the movement feedback portion 5.

In this case, for example, the start point 32 and the end point 33 (and also the via-point 34, if necessary) are displayed on the display 51 of the movement feedback portion 5, and the present position of the hand 2 of the patient 1 measured by the movement measuring portion 4 are displayed in real time during the feedforward-movement. The patient 1 moves the grip rod on the working table 31 of the movement working portion 3 while watching the display 51 in such a way that the rod moves from the start point 32 to the end point 33, if necessary through the via-point 34, on the display 51. Thus, the patient is trained in the feedforward-movement.

Of course, these start point 32, end point 33, and via-point 34 may be both placed on the movement working portion 3 and displayed on the movement feedback portion 5.

The training of the feedforward-movement using the feedforward-movement training apparatus of this invention as described above can cause his or her brain to learn the state of the body changed due to paralysis or the like. This improves the control over the body part such as an arm. As the arm or the like is controlled better, its joints gradually become less stiff. In consequence, for example, the paralyzed upper limb that tends to stiffen due to hyperreflexia or coactivation of muscles can be relaxed. Hence, the function permitting the patient to do quick and precise movements in a relaxed state can be effectively restored.

As the feedforward-movement progresses, the trajectory of the movement and the torque waveform become gradually smoother. Furthermore, as the learning of the dynamics model in the brain progresses, the patient can do the movement at a higher speed and more accurately while maintaining the arm and the like in a compliant state. Accordingly, the restoration of a fast and accurate motor function under a relaxed state can be promoted more effectively by quantitatively and objectively evaluating "smoothness" and "compliance" of the feedforward-movement during training.

Figure 2:
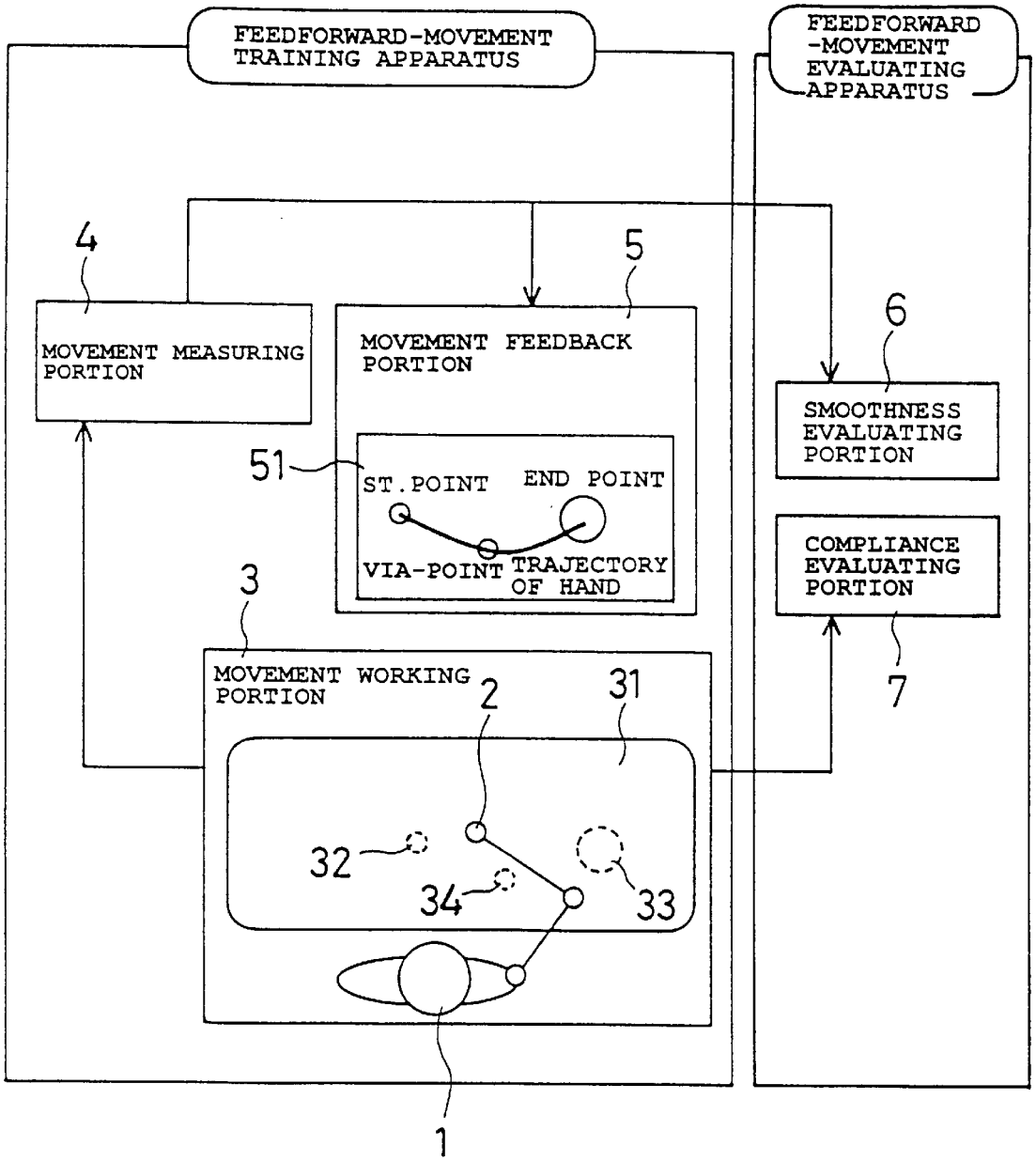
FIG. 2 is a schematic view showing main portions of one example of feedforward-movement evaluating apparatus of this invention.

Therefore, using the feedforward-movement evaluating system of this invention in which, as shown in FIG. 2, the aforementioned feedforward-movement training apparatus is combined with a feedforward-movement evaluating apparatus, and the "smoothness" and the "compliance" of a feedforward-movement can be assessed objectively and quantitatively. Using its assessment, the patient can be trained more effectively in the feedforward-movement.

The feedforward-movement evaluating apparatus incorporated in the feedforward-movement evaluating system exemplified in FIG. 2 has a smoothness evaluating portion 6 and a compliance evaluating portion 7. The smoothness evaluating portion 6 evaluates the smoothness of the feedforward-movement, using the results of various measurements of the feedforward-movement made by the movement measuring portion 4 of the feedforward-movement training apparatus. The compliance evaluating portion 7 evaluates the compliance of the feedforward-movement, using muscle tension of the body part of the patient doing the feedforward-movement on the movement working portion 3.

It is considered that smooth movement is a motion whose acceleration involves less change. Therefore, the smoothness can be quantified by the magnitude of jerk that is the change of acceleration. The magnitude of jerk is a value obtained by the first differentiation of the acceleration.

Thus, the smoothness evaluating portion 6 evaluates the degree of smoothness of the whole movement by adding the magnitudes (sum of the squares) of jerks over the whole movement. It is indicated that as this value decreases, the movement becomes smoother.

The first differentiation of acceleration can be obtained from the third differentiation of the position of the hand 2 and of the joint angle. Therefore, using the position of the hand 2 and the joint angle measured by the movement measuring portion 4 during the feedforward-movement, an objective function value of minimum hand jerk and that of minimum joint angle jerk are calculated on every trial of the feedforward-movement. And, the change in each objective function value with time from the beginning of training is obtained. Using this change in each objective function value over time, the degree of increase in the smoothness of the hand 2 and the joint doing the feedforward-movement is evaluated.

The minimum hand jerk may be obtained by the known formula (see Flash T & Hogan N, 1985, *J. Neurosci.* 5, pp. 688–1703) given by;

$$J_J = 1/2\int_0^{t_f}\left\{(d^3X/dt^3)^2 + (d^3Y/dt^3)^2\right\}dt$$

where (X, Y) is the measured position of the body part such as the hand 2 and $t_f$ is the duration of the movement. The degree of smoothness of the hand 2 is then calculated by entering the measured position of the hand 2 into (X, Y). It can be seen that as this degree of smoothness decreases, the movement of the hand 2 becomes smoother.

The minimum joint angle jerk may be obtained by the known formula (see Hideko Oosuri, Yoji Uno, Yasuharu Koike, and Mitsuo Kawato, "Medical Electronics and Biological Engineering", 34, 1996, pp. 394–405) given by;

$$J_\theta = 1/2\int_0^{t_f}\sum_{i=1}^{n}(d^3\theta_i/dt^3)^2\,dt$$

where $\theta_i$ is the joint angle of the ith joint. The degree of smoothness of the joint can be calculated by inserting the measured position of the joint angle into θ. It can be understood that as this degree of smoothness decreases, the movement of the joint becomes smoother.

Furthermore, the smoothness of torque, i.e., the smoothness of force, can be evaluated by using torque supplied to the joint. The smoothness evaluating portion 6 may calculate the objective function value of minimum torque change on every trial of the feedforward-movement and find the changes over time from the beginning of the training.

This minimum torque change may be obtained by the known formula (Uno Y, Kawato M & Suzuki R. *Biol. Cybern.*, 1989, 61, pp. 89–101) given by;

$$J_\tau = 1/2\int_0^{t_f}\sum_{i=1}^{n}(d\tau_i/dt)^2\,dt$$

where $\tau_i$ is the torque supplied to the ith joint. The degree of smoothness of the joint torque is calculated by inserting the torque calculated from the joint angle into τ. It can be seen that as this degree of smoothness decreases, the torque becomes smoother.

On the other hand, in the case of feedforward-movement training of the hand 2, since the compliance of movement can be evaluated from the stiffness of arm, the compliance evaluating portion 7 obtains muscle tension proportional to the stiffness. Relative change of this muscle tension can be monitored at any time by an electromyogram, for example. And, the integrated value of the electromyogram is found on every trial of the feedforward-movement, and the change in the integrated value over time from the beginning of the training is found. In this way, the degree of increase of the compliance can be evaluated.

For example, in the case of an arm, the integrated values of electromyograms of the six muscles (i.e., shoulder flexor, shoulder extensor, biarticular flexor, biarticular extensor, elbow flexor, and elbow extensor) associated with movements of the shoulder and elbow in the horizontal plane are calculated. Decrease of 5–10% or more in this integrated value compared with that obtained at the beginning of training may be established as an objective goal, and the patient is trained in the feedforward-movement so as to achieve this goal.

By not only achieving the goal such as to go to the end point 33 through the via-point 34 within the time limit but also reducing the aforementioned objective function value, that is, for example, training to bring the objective function value close to that derived from a healthy (normal) body part doing the same movement or from a healthy person, it is possible to improve a fast and accurate motor function in a relaxed state more effectively.

If the feedforward-movement evaluating apparatus is equipped with the smoothness evaluating portion 6, the movement measuring portion of the feedforward-movement evaluating apparatus in this feedforward-movement training system, it is preferable to use a sampling frequency of about 200 Hz or more.

The example described above pertains to the feedforward-movement training of the hand 2. Of course, other body parts such as a leg can be similarly trained in feedforward-movement, thereby effectively recovering their fast and accurate motor functions in a relaxed state. In the case of a leg, similarly, the smoothness objective function values can be calculated using the aforementioned Eqs. (1), (2), and (3), and the smoothness can be evaluated objectively. Also, the compliance can be evaluated from muscle tension using an electromyogram or the like.

Although the feedforward-movement evaluating apparatus shown in FIG. 2 is equipped with both the smoothness evaluating portion 6 and the compliance evaluating portion 7, it is not necessary that the apparatus be equipped with both of these portions 6 and 7, the apparatus may be equipped with only one of them.

Examples of the invention are hereinafter described with reference to the accompanying drawings, and the preferred embodiments of the invention will be described in further detail.

EXAMPLES

Using the feedforward-movement evaluating system of the present invention shown in FIG. 2, hands 2 of two patients A and B were trained in feedforward-movements.

Circles having radii of 1 cm, 2 cm, and 2.5 cm, respectively, were used as the start point 32, the via-point 34, and the end point 33 on the movement working portion 3 of the feedforward-movement training apparatus. The start point 32 and the end point 33 were placed with a distance of about 45 cm therebetween and at a position of about 35 cm apart from the body of the patient 1 in such a way that the movement becomes parallel to the body. The via-point 34 was placed between the start point 32 and the end point 33 and at a position about 7 cm closer to the body. The time limit of moving from the start point 32 to the end point 33 was set to 600 msec so as to maximize the speed of movement within the patient's movement capability.

The trajectory of the hand 2 and the results of the movement measurements such as whether passing through the via-point 34 was achieved and whether reaching the end point 33 within the time limit was achieved were displayed and given to the patients A and B after every trail of the training by the movement feedback portion 5. The training was repeated until the number of successful trials reached a goal number (e.g., about 20). The patient A suffered from left hemiparesis due to putaminal hemorrhage. A lesion was situated in a part of the pyramidal tract. The paralysis was at a moderate level. Hyperreflexia was observed. No abnormality was found in the senses.

The patient B suffered from left hypesthesia due to hypothalamic bleeding.

Figure 3:
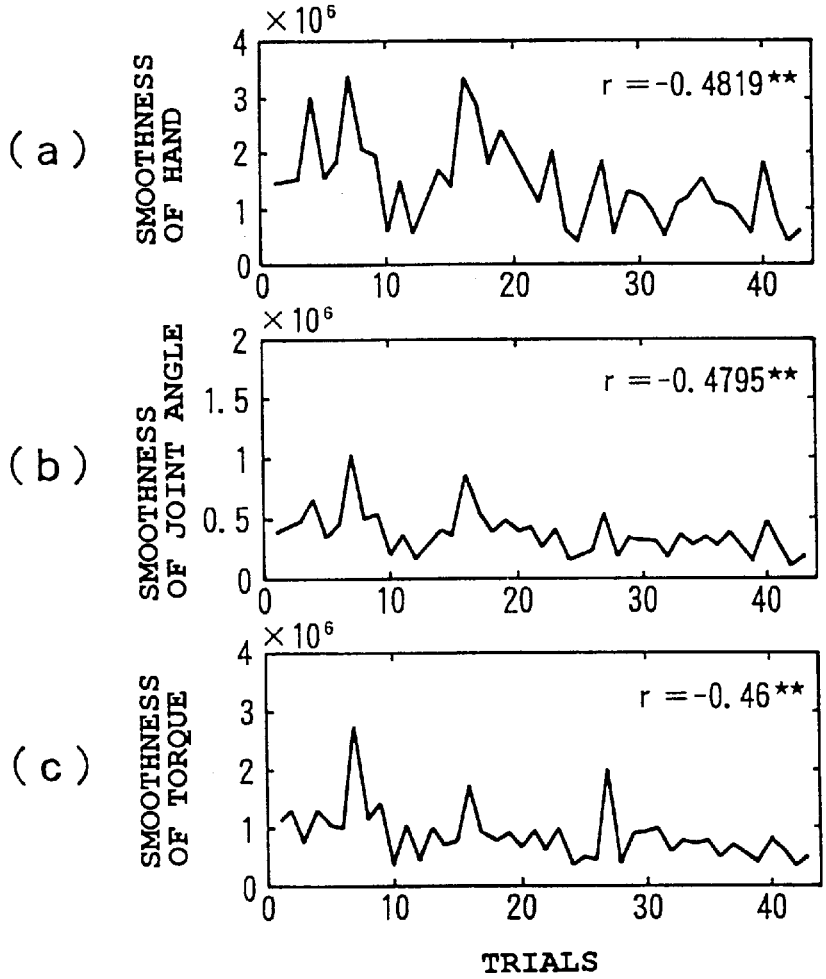
FIGS. 3(*a*), 3(*b*), and 3(*c*) show an example of the changes over time in the smoothness of hand, joint angle, and torque for the patient A, respectively.
Figure 4:
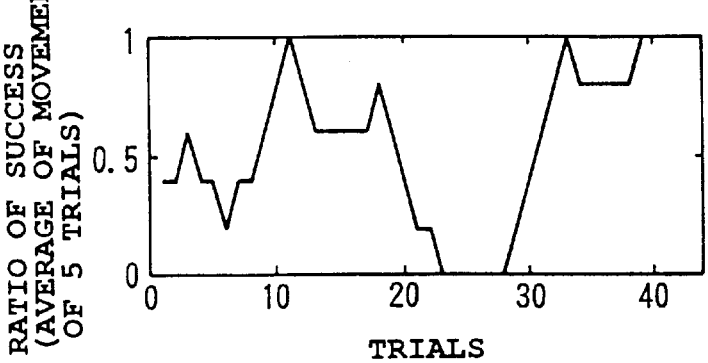
FIG. 4 is a diagram showing an example of the ratio of success of the patient A.
Figure 5:
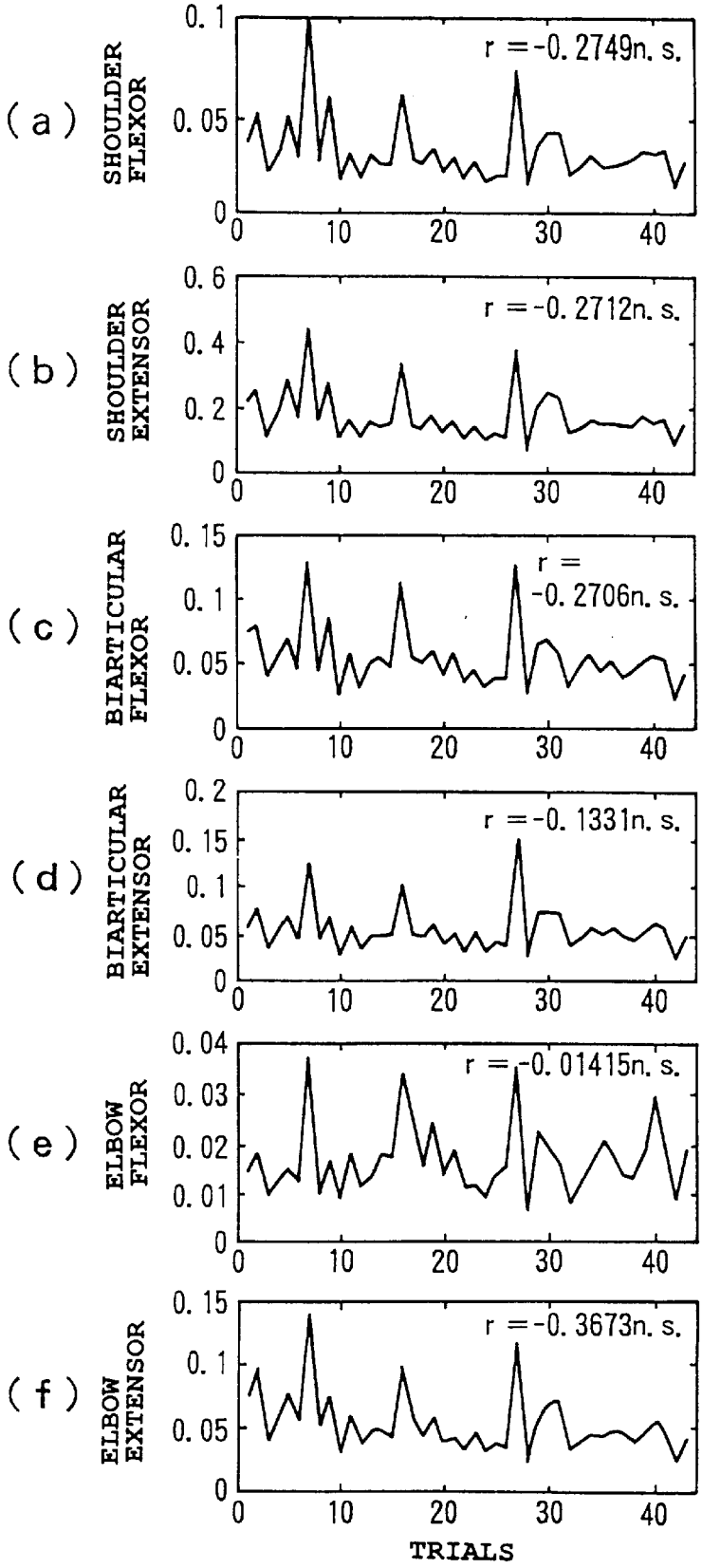
FIGS. 5(*a*)–(*f*) show an example of the changes over time in the muscular activities of shoulder flexor, shoulder extensor, biarticular flexor, biarticular extensor, elbow flexor, and elbow extensor for the patient B, respectively.
Figure 6:
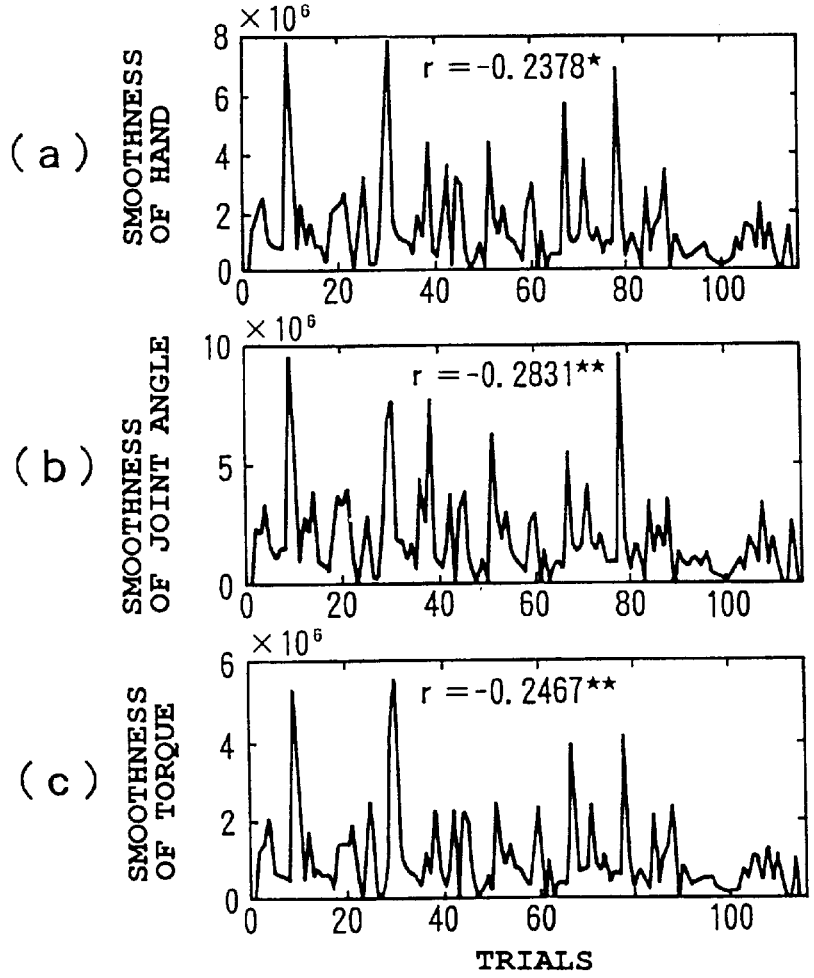
FIGS. 6(*a*), 6(*b*), and 6(*c*) show an example of the results of evaluations of the smoothness of hand, joint angle, and torque for the patient B, respectively.
Figure 7:
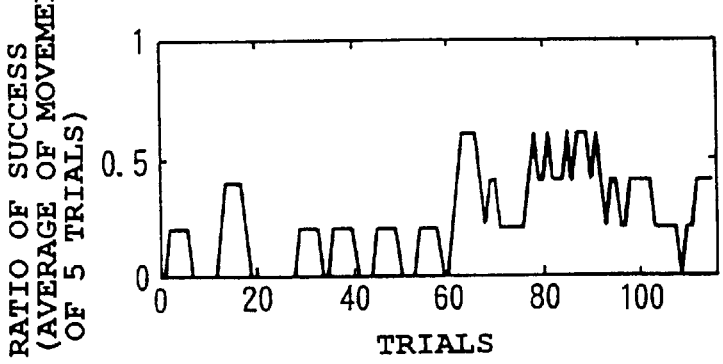
FIG. 7 is a diagram showing an example of ratio of success of the patient B.
Figure 8:
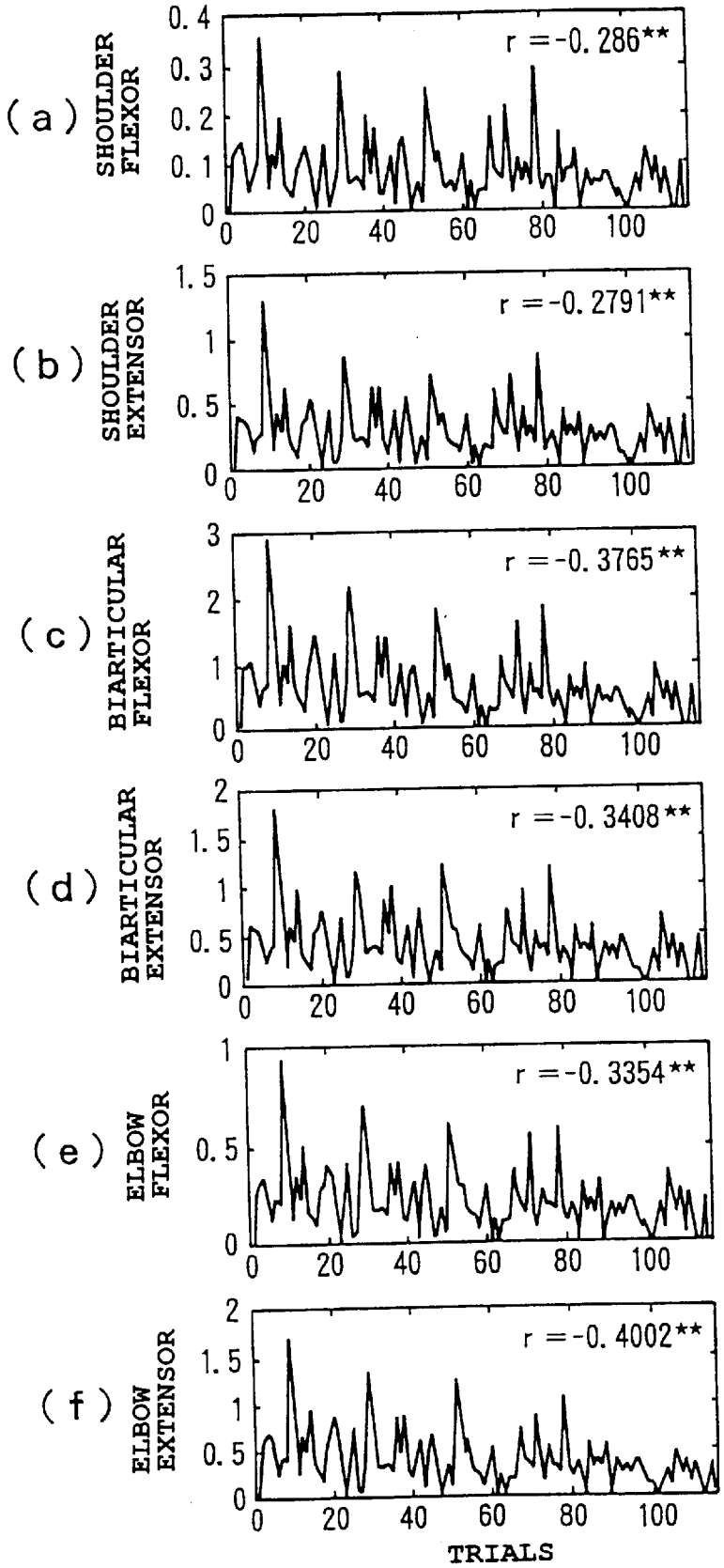
FIGS. 8(*a*)–(*f*) show an example of the changes over time in the muscular activities of shoulder flexor, shoulder extensor, biarticular flexor, biarticular extensor, elbow flexor, and elbow extensor for the patient B, respectively.

FIGS. 3(*a*), 3(*b*), 3(*c*), FIG. 4, and FIGS. 5(*a*)–(*f*) show the change in each objective function value of smoothness over time, the success ratio, and the change in each activation of the 6 muscles over time,respectively,for the patient A. FIGS. 6(*a*), 6(*b*), 6(*c*), FIGS. 7, and FIGS. 8(*a*)–(*f*) show the change in each objective function value of smoothness over time, the success ratio, and the change in each muscular activation of the six muscles over time, respectively, for the patient B.

It can be easily and quantitatively understood from these FIGS. 3–8 that, for both patients, the objective function value of smoothness of the hand 2, the objective function value of smoothness of the joint angle, and the evaluation function of smoothness of the torque decreased with progress of the training. The functions of fast and accurate movements improved owing to the training in the feedforward-movement. The degree of each muscular activation of the shoulder flexor, shoulder extensor, biarticular flexor, biarticular extensor, elbow flexor, and elbow extensor decreased, though differences existed between both patients. Thus, the training enabled the patients to move the arm in a compliant state, and the ratio of success of the goal increased.

Figure 9:
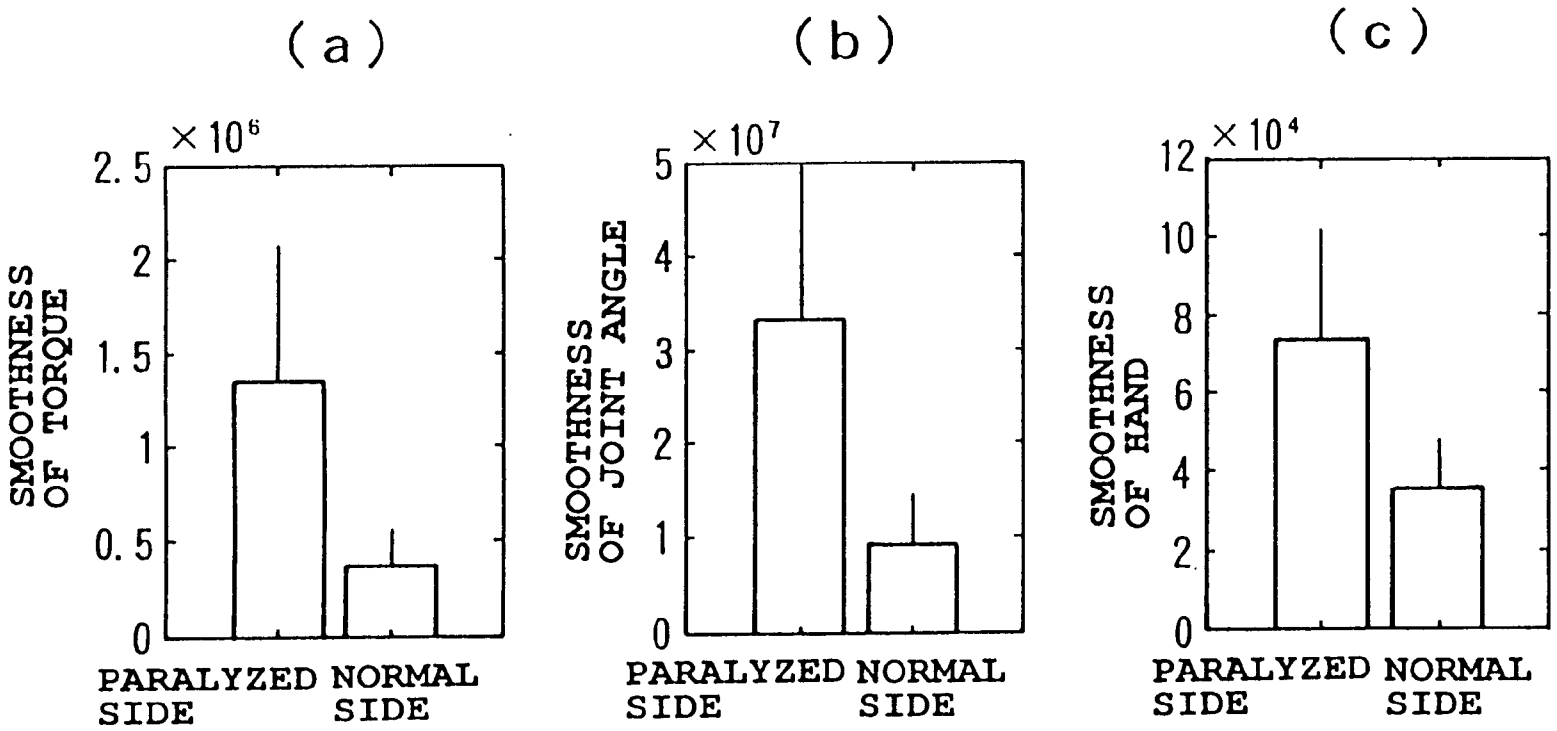
FIGS. 9(*a*), 9(*b*), and 9(*c*) show an example of the average and the standard deviation of objective function values of the smoothness of hand, joint angle, and torque for the paralyzed side and healthy (i.e., normal) side in the patient A, respectively.

FIGS. 9(*a*), 9(*b*), and 9(*c*) show the average value and standard deviation of each objective function value, for both the paralyzed side and the healthy (normal) side of the patient A, of smoothness of the hand, the smoothness of the joint angle, and the smoothness of torque, respectively. From these FIGS. 9(*a*), 9(*b*), and 9(*c*), it is obvious that the objective function value derived from the paralyzed side are significantly higher than the objective function value derived from the normal side, and it can be quantitatively seen that the motor functions of the paralyzed side are deteriorated due to the impairments.

It is to be understood, of course, that this invention is not limited to the above example and that various changes and modifications to the details are possible.

INDUSTRIAL APPLICABILITY

As described in detail thus far, the feedforward-movement training apparatus and feedforward-movement evaluating system in accordance with this invention can evaluate the degree of skillfulness of patient's feedforward-movements objectively and easily, and thus can effectively recover patient's functions enabling fast and accurate movements in a relaxed state.

What is claimed is:

1. A feedforward-movement training apparatus for use by a patient, said feedforward-movement training apparatus comprising:

a movement working portion operable to be moved by the patient from a predetermined start point to a predetermined end point within a time limit in a feedforward-movement of a body part of the patient, wherein the start and end points are visible to the patient in advance of the feedforward-movement by the patient;

a movement measuring portion for measuring the feedforward-movement of the body part of the patient based on movement of said movement working portion; and a movement feedback portion for giving a result of the measurement made by said movement measuring portion to the patient.

2. A feedforward-movement training apparatus according to claim 1, wherein said movement working portion is operable to be moved by the patient from the start point to the end point through at least one predetermined via point.

3. A feedforward-movement training apparatus according to claim 1, wherein the start point and the end point are located on said movement working portion.

4. A feedforward-movement training apparatus according to claim 3, wherein the at least one via point is located on said movement working portion.

5. A feedforward-movement training apparatus according to claim 1, wherein said movement measuring portion is operable to measure a trajectory of the feedforward-movement.

6. A feedforward-movement training apparatus according to claim 1, wherein said movement measuring portion is operable to measure a position of the body part of the patient during the feedforward-movement.

7. A feedforward-movement training apparatus according to claim 1, wherein said movement measuring portion is operable to measure a duration taken to complete the feedforward-movement.

8. A feedforward-movement training apparatus according to claim 1, wherein said movement feedback portion is operable to display the result of the measurement of the feedforward-movement to the patient.

9. A feedforward-movement training apparatus according to claim 8, wherein said movement feedback portion is operable to display the position of the body part of the patient in real-time during the feedforward movement.

10. A feedforward-movement training apparatus according to claim 1, wherein said movement feedback portion is operable to display the start point and the end point.

11. A feedforward-movement training apparatus according to claim 10, wherein said movement feedback portion is operable to display the at least one via point.

12. A feedforward-movement evaluating system comprising a feedforward-movement training apparatus according to claim 1, and a feedforward-movement evaluating apparatus operable to evaluate a degree of skillfulness of the feedforward-movement done by the patient in said feedforward-movement training apparatus.

13. A feedforward-movement evaluating system according to claim 12, wherein said feedforward-movement evaluating apparatus has a smoothness evaluating portion operable to evaluate a smoothness of the feedforward-movement based on the result of the measurement of the feedforward-movement made by said movement measuring portion of said feedforward-movement training apparatus.

14. A feedforward-movement evaluating system according to claim 13, wherein said feedforward-movement evaluating apparatus is operable to calculate a minimum joint-angle jerk and a minimum torque change as a smoothness objective function value based on the result of the measurement of the feedforward-movement made by said movement measuring portion of said feedforward-movement training apparatus.

15. A feedforward-movement evaluating system according to claim 12, wherein said feedforward-movement evaluating apparatus has a compliance evaluating portion operable to evaluate compliance of the feedforward-movement based on muscle tension of the body part doing the feedforward-movement.

16. A feedforward-movement evaluating system according to claim 15, wherein said feedforward-movement evaluating apparatus is operable to calculate an integrated value of an electromyogram indicating relative change of muscle tension.

* * * * *